US010825387B2

(12) United States Patent
Li

(10) Patent No.: US 10,825,387 B2
(45) Date of Patent: Nov. 3, 2020

(54) PIXEL DRIVING CIRCUIT AND DISPLAY APPARATUS

(71) Applicant: Wuhan China Star Optoelectronics Semiconductor Display Technology Co., Ltd., Wuhan (CN)

(72) Inventor: Jun Li, Shenzhen (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 139 days.

(21) Appl. No.: 16/136,271

(22) Filed: Sep. 20, 2018

(65) Prior Publication Data

US 2019/0304363 A1 Oct. 3, 2019

Related U.S. Application Data

(63) Continuation of application No. PCT/CN2018/096193, filed on Jul. 19, 2018.

(30) Foreign Application Priority Data

Mar. 30, 2018 (CN) ..... 2018 1 0294388

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0819* (2013.01); *G09G 2300/0842* (2013.01); *G09G 2300/0871* (2013.01); *G09G 2310/0243* (2013.01); *G09G 2320/043* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,903,059 | B2 | 3/2011 | Chiou et al. | |
| 8,289,313 | B2 | 10/2012 | Lee et al. | |
| 8,514,152 | B2 | 8/2013 | Park | |
| 9,018,842 | B2 | 4/2015 | Tan et al. | |
| 2010/0194716 | A1* | 8/2010 | Park | G09G 3/3233 345/204 |

(Continued)

FOREIGN PATENT DOCUMENTS

KR 20070027265 A 3/2007

*Primary Examiner* — William Boddie
*Assistant Examiner* — Alecia D English

(57) ABSTRACT

The present disclosure provides a pixel driving circuit and a display apparatus. The circuit includes a reset module, a compensation module, and a light-emitting module. The reset module receives a first control signal and transmits a reset voltage to the compensation module and the light-emitting module according to the first control signal for resetting the compensation module and the light-emitting module. The compensation module receives a second control signal and write data signal according to the second control signal for compensating a threshold voltage. The light-emitting module receives a third control signal and a fourth control signal for emitting light according to the thud and fourth control signals.

8 Claims, 3 Drawing Sheets

(56) References Cited

U.S. PATENT DOCUMENTS

| | | | | |
|---|---|---|---|---|
| 2015/0364087 | A1* | 12/2015 | Gu | G09G 3/3233 345/78 |
| 2017/0186782 | A1* | 6/2017 | Lee | H01L 27/1225 |
| 2017/0193927 | A1* | 7/2017 | Yang | G09G 3/3426 |
| 2017/0301293 | A1* | 10/2017 | Zhu | G09G 3/3208 |

* cited by examiner

PIXEL DRIVING CIRCUIT AND DISPLAY APPARATUS

CROSS-REFERENCE TO RELATED APPLICATIONS

The present application is a continuation-application of International (PCT) Patent Application No. PCT/CN2018/096193, filed on Jul. 19, 2018 which claims foreign priority of Chinese Patent Application No. 201810294388.9, filed on Mar. 30, 2018 in the State Intellectual Property Office of China, the contents of all of which are hereby incorporated by reference.

TECHNICAL FIELD

The described embodiments relate to display technologies, and in particular to a pixel driving circuit and a display apparatus.

BACKGROUND

Organic light-emitting diodes (OLEDs) have advantages of wide color, high contrast, energy saving and folding, so they are competitive in the new generation display. Among them, active matrix organic light-emitting diode (AMOLED) technology is one of the key development directions of flexible display. A basic driving circuit of the AMOLED is shown in FIG. 1, which is in a 2T1C mode, including two thin film transistors and a memory capacitor. Specifically, the basic driving circuit includes a switching thin film transistor A1, a driving thin film transistor A2, and a memory capacitor C1. A driving current of the OLED is controlled by the driving thin film transistor A2, the driving current is satisfied with a formula: $I_{OLED}=k(V_{gs}-V_{th})^2$; wherein K is the current amplification factor of the driving thin film transistor A2, which is determined by the characteristics of the driving thin film transistor A2; Vgs is a voltage between a gate and a source of the driving thin film transistor A2; Vth is a threshold voltage of the driving thin film transistor A2. Because of a long operation, the threshold voltage Vth of the driving thin film transistor A2 may be drifted, which will lead to change of the driving current, and make the OLED panel appear bad picture and affect picture quality.

SUMMARY

In view of this, the present disclosure provides a pixel driving circuit and a display apparatus, which can provide a threshold voltage compensation to improve display characteristics of a display apparatus.

A pixel driving circuit of according to an embodiment of the present disclosure includes a reset module, to receive a first control signal and transmit a reset voltage to a compensation module and a light-emitting module according to the first control signal for resetting the compensation module and the light-emitting module;

the compensation module, to receive a second control signal and write data signal according to the second control signal for compensating a threshold voltage; and the light-emitting module, to receive a third control signal and a fourth control signal for emitting light according to the third and fourth control signals;

wherein, the reset module comprises a second thin film transistor (TFT) and a fourth TFT, a gate of the second TFT receives the first control signal, a source of the second TFT is connected to a drain of the fourth TFT, a drain of the second TFT is connected to the compensation module; a gate of the fourth TFT receives the first control signal, a source of the fourth TFT receives the reset voltage, a drain of the fourth TFT is connected to the source of the second TFT;

the compensation module comprises a first TFT, a third TFT, and a storage capacitor, a gate of the first TFT is connected to an end of the storage capacitor and the drain of the second TFT, a drain of the first TFT is connected to the source of the second TFT, a source of the first TFT is connected to a drain of the third TFT; a gate of the third TFT receives the second control signal, a source of the third TFT receives the data signal; another end of the storage capacitor is connected to a first voltage;

the light-emitting t nodule comprises a fifth TFT, a sixth TFT, and a light-emitting element, a gate of the fifth TFT receives the third control signal, a drain of the fifth TFT is connected to the source of the second TFT, a source of the fifth TFT is connected to the drain of the fourth TFT; a gate of the sixth TFT receives the fourth control signal, a drain of the sixth TFT is connected to the first voltage, a source of the sixth TFT is connected to the source of the first TFT; an anode of the light-emitting element is connected to the source of the fifth T and the drain of the fourth TFT, a cathode of the light-emitting element s connected to a second voltage;

when the light-emitting element is light, a driving current through the light-emitting element is satisfied with a formula: $I_{OLED}=k(VDD-(Vdata-|Vth|)-|Vth|)^2=k(VDD-Vdata)^2$; wherein $I_{OLED}$ is the driving current, VDD is the first voltage, data is a voltage of the data signal, K is a current amplification factor of the first TFT;

a work process of the pixel driving circuit comprises three stages, which are a first stage, a second stage, and a third stage; in the first stage, the first control and the third control signal are valid, and the second control signal and the fourth control signal are invalid; in the second stage, the first control signal and the second control signal are valid, and the third control signal and the fourth control signal are invalid; in the third stage, the third control signal and the fourth control signal are valid, and the third control signal and the second control signal are invalid.

A pixel driving circuit of according to an embodiment of the present disclosure includes a reset module, to receive a first control signal and transmit a reset voltage to a compensation d and a light-emitting module according to the first control signal for resetting the compensation module and the light-emitting module;

the compensation module, to receive a second control signal and write data signal according to the second control signal for compensating a threshold voltage; and the light-emitting module, to receive a third control signal and a fourth control signal for emitting light according to the third and fourth control signals.

A display apparatus of according to an embodiment of the present disclosure includes a pixel driving circuit, the pixel driving circuit includes a reset module, to receive a first control signal and transmit a reset voltage to a compensation module and a light-emitting module according to the first control signal for resetting the compensation module and the light-emitting module;

the compensation module, to receive a second control signal and write data signal according to the second control signal for compensating a threshold voltage; and the light-emitting module, to receive a third control signal and a fourth control signal for emitting light according to the third and fourth control signals.

The present disclosure has the following advantages: different from the related art, the present disclosure includes the reset module, the compensation module, and the light-emitting module. The reset module receives the first control signal and transmits the reset voltage to the compensation module and the light-emitting module according to the first control signal, to reset the compensation module and the light-emitting module. The compensation module receives the second control signal and writes data signal according to the second control signal, to compensate the threshold voltage. The light-emitting module receives the third control signal and the fourth control signal to emit light according to the third and fourth control signals. In this way, the present disclosure can provide a threshold voltage compensation function to improve display characteristics of the display apparatus.

DETAILED DESCRIPTION

A clear and complete description of the technical schemes in the embodiments of the present disclosure will be made below with reference to the accompanying drawings in the embodiments of the present disclosure. Apparently, the embodiments as recited herein are merely a part of embodiments of the present disclosure instead of all embodiments. All other embodiments obtained by a person of ordinary skill in the art based on the embodiments of the present disclosure without creative efforts shall fall within the protection scope of the present disclosure.

Figure 1:
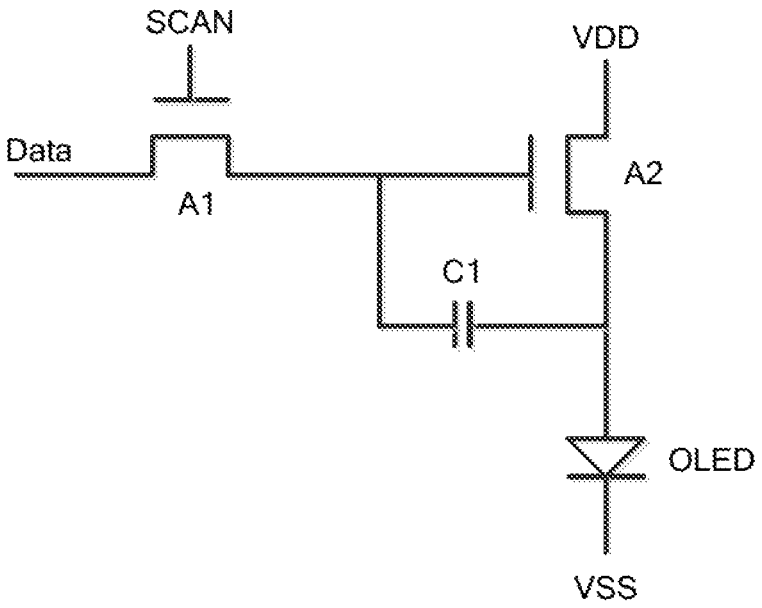
FIG. 1 (related art)
FIG. 1 is a circuit diagram of a pixel driving circuit of the related art.
Figure 2:
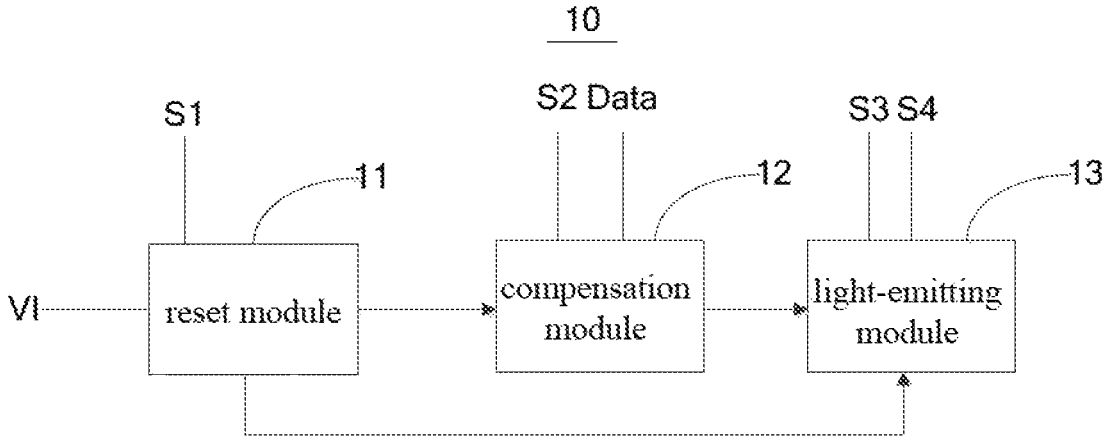
FIG. 2 is a schematic diagram of a pixel driving circuit according to an embodiment of the present disclosure.

Referring to FIG. 2, it shows a schematic diagram of a pixel driving circuit of the present disclosure. The pixel driving circuit 10 includes a reset module 11, a compensation module 12, and a light-emitting module 13.

The reset module 11 is connected to the compensation module 12 and the light-emitting module 13. The compensation module 12 is connected to the light-emitting module 13.

The reset module 11 is configured to receive a first control signal S1 and transmit a reset voltage VI to the compensation module 12 and the light-emitting module 13 according to the first control signal S1, to reset the compensation module 12 and the light-emitting module 13.

The compensation module 12 is configured to receive a second control signal S2 and write data signal Data according to the second control signal S2, to compensate a threshold voltage.

The light-emitting module 13 is configured to receive a third control signal S3 and a fourth control signal S4 and emit light according to the third control signal S3 and the fourth control signal S4.

Figure 3:
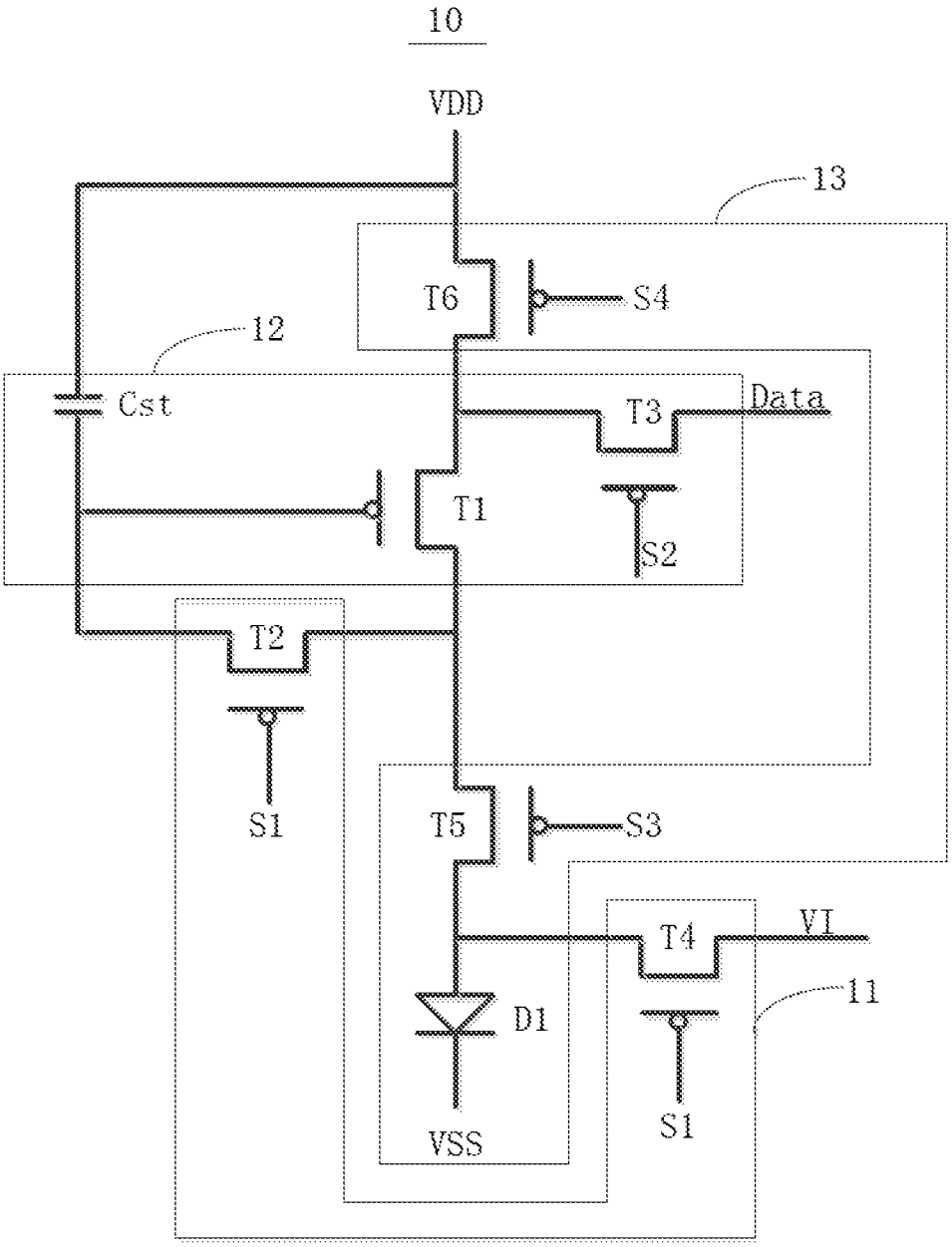
FIG. 3 is a circuit diagram of the pixel driving circuit of FIG. 2.

Referring to FIG. 3, it shows a circuit diagram of the pixel driving circuit of FIG. 2. The reset module 11 includes a second thin film transistor (TFT) T2 and a fourth TFT T4. The compensation module 12 includes a first TFT T1, a third TFT T3, and a storage capacitor Cst. The light-emitting module 13 includes a fifth TFT T5, a sixth TFT T6, and a light-emitting element D1.

A gate of the second TFT T2 receives the first control signal S1. A source of the second TFT T2 is connected to a drain of the fourth TFT T4 through the fifth TFT T5. A drain of the second TFT T2 is connected to a gate of the first TFT T1 of the compensation module 12. A gate of the fourth TFT T4 receives the first control signal S1. A source of the fourth TFT T4 receives the reset voltage VI. A drain of the fourth TFT T4 is connected to the source of the second TFT T2 through the fifth TFT T5.

A gate of the first TFT T1 is connected to an end of the storage capacitor Cst and the drain of the second TFT T2. A drain of the first TFT T1 is connected to the source of the second TFT T2. A source of the first TFT T1 is connected to a drain of the third TFT T3. A gate of the third TFT T3 receives the second control signal S2. A source of the third TFT T3 receives the data signal Date. Another of the storage capacitor Cst is connected to a first voltage VDD.

A gate of the fifth TFT T5 receives the third control signal S3. A source and a drain of the fifth TFT T5 are connected between the source of the second TFT T2 and the drain of the fourth TFT T4. Specifically, the drain of the fifth TFT T5 is connected to the some of the second TFT T2. The source of the fifth TFT T5 is connected to the drain of the fourth TFT T4. A gate of the sixth TFT T6 receives the fourth control signal S4. A drain of the sixth TFT T6 is connected to the first voltage VDD. A source of the sixth TFT T6 is connected to the source of the first TFT T1. An anode of the light-emitting element D1 is connected to the source of the fifth TFT T5 and the drain of the fourth TFT T4. A cathode of the light-emitting D1 is connected to a second voltage VSS. In one embodiment, the light-emitting element D1 is an organic light-emitting diode.

In one embodiment, the first voltage VDD is a high level signal. The reset voltage VI and the second voltage VSS are low level signals.

In one embodiment, the first TFT T1 is a driving TFT. The second TFT T2 to the sixth TFT T6 are switch TFTs. The first TFT T1 to the seventh TFT T7 are P-type TFTs: namely, the low level signals control the first TFT T1 to the seventh TFT T7 to be turned on. In other embodiments, these TFTs of the present disclosure may be N-type or in combination with N-type and P-type, the drain and the source of each of these TFTs may be exchanged when each TFT is as switch TFT.

Figure 4:
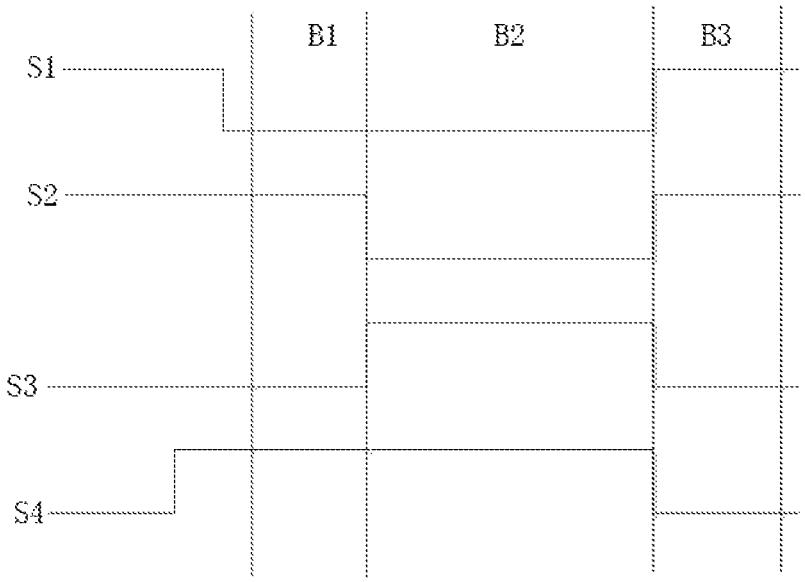
FIG. 4 is a waveform diagram of the pixel driving circuit of FIG. 3.

Referring to FIG. 4, it shows a waveform diagram of the pixel driving circuit of FIG. 3. A work process of the pixel driving circuit 10 includes three stages, which are a first stage B1, a second stage B2, and a third stage B3.

The first stage B1 is a reset stage. In the first stage B1, the first control signal S1 and the third control signal S3 are valid, and the second control signal S2 and the fourth control signal S4 are invalid. In another way, in the first stage, the first control signal S1 and the third control signal S3 are low levels signals, and the second control signal S2 and the fourth control signal S4 are high level signals. In this time, the fourth TFT T4 is turned on. The reset voltage VI is received by the source of the fourth TFT T4 and outputted from the drain of the fourth TFT T4. The anode of the light-emitting element D1 is connected to the drain of the fourth TFT T4. Thus, the anode of the light-emitting element D1 is reset to the reset voltage VI. Besides, the fifth TFT T5 and the second TFT T2 are turned on. The gate of the first TFT T1 is connected to the drain of the fourth TFT T4 through the fifth TFT T5 and the second TFT T2. Thus, the gate of the first TFT T1 is reset to the reset voltage VI.

The second stage B2 is a writing data and compensation threshold voltage stage. In the second stage B2, the first control signal S1 and the second control signal S2 are valid, and the third control signal S3 and the fourth control signal S4 are invalid. In another way, in the second stage B2, the first control signal S1 and the second control signal S2 are low level signals. The third control signal S3 and the fourth control signal S4 are high level signals. In this time, the second TFT T2 are turned on, to make the gate and the drain of the first TFT T1 be connected for forming a diode connect structure. The third TFT T3 is turned on. The data signal Data received by the source of the third TFT T3 is transmitted to the source of the first TFT T1 through the drain of the third TFT T3, to charge the gate of the first TFT T1 to Vdata−|Vth| through the diode connect structure of the first TFT T1. Wherein Vth is a threshold voltage of the first TFT T1, Vdata is a voltage of the data signal Data.

The third stage B3 is a light-emitting stage. In the third stage B3, the third control signal S3 and the fourth control signal S4 are valid, and the first control signal S1 and the second control signal S2 are invalid. In another way, in the third stage B3, the third control signal S3 and the fourth control signal S4 are low level signals. The first control signal S1 and the second control signal S2 are high level signals. When the fifth TFT T5 and the sixth TFT T6 are turned on, the driving current through the light-emitting element D1 is satisfied with a formula: $I_{OLED}=k(VDD-(Vdata-|Vth|)-|Vth|)^2=k(VDD-Vdata)^2$; wherein $I_{OLED}$ is the driving current; VDD is the first voltage; Vdata is the voltage of the data signal Data; K is a current amplification factor of the first TFT T1.

It can be seen from the above formula, the driving current $I_{OLED}$ is independent of the threshold voltage Vth of the first TFT T1, Thus, a problem of bad picture display caused by drift of the threshold voltage Vth of the first TFT T1 can be eliminated.

Figure 5:
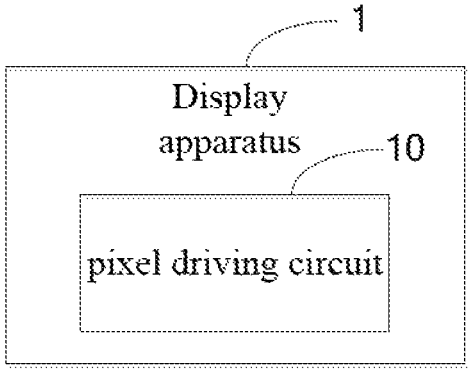
FIG. 5 is a schematic diagram of a display apparatus according to an embodiment of the present disclosure.

Referring to FIG. 5, it shows a schematic diagram of a display apparatus according to an embodiment of the present disclosure. The display apparatus 1 includes the pixel driving circuit 10.

The pixel driving circuit and the display apparatus includes the reset module, the compensation module, and the light-emitting module. The reset module receives the first control signal and transmits the reset voltage to the compensation module and the light-emitting module according to the first control signal, to reset the compensation module and the light-emitting module. The compensation module receives the second control signal and writes data signal according to the second control signal, to compensate the threshold voltage. The light-emitting module receives the third control signal and the fourth control signal to emit light according to the third and fourth control. In this way, the present disclosure can provide a threshold voltage compensation function to improve display characteristics of the display apparatus.

The foregoing is merely embodiments of the present disclosure, and is not intended to limit the scope of the disclosure. Any transformation of equivalent structure or equivalent process which uses the specification and the accompanying drawings of the present disclosure, or directly or indirectly application in other related technical fields, are likewise included within the scope of the protection of the present disclosure.

What is claimed is:

1. A pixel driving circuit, comprising:

a reset module, configured to receive a first control signal and transmit a reset voltage to a compensation module and a light-emitting module according to the first control signal for resetting the compensation module and the light-emitting module;

the compensation module, configured to receive a second control signal and write data signal according to the second control signal for compensating a threshold voltage; and the light-emitting module, configured to receive a third control signal and a fourth control signal for emitting light according to the third and fourth control signals;

wherein the reset module comprises a second thin film transistor (TFT) and a fourth TFT, a gate of the second TFT receives the first control signal, a source of the second TFT is connected to a drain of the fourth TFT, a drain of the second TFT is connected to the compensation module; a gate of the fourth TFT receives the first control signal, a source of the fourth TFT receives the reset voltage, a drain of the fourth TFT is connected to the source of the second TFT;

the compensation module comprises a first TFT, a third TFT, and a storage capacitor, a gate of the first TFT is connected to an end of the storage capacitor and the drain of the second TFT, a drain of the first TFT is connected to the source of the second TFT, a source of the first TFT is connected to a drain of the third TFT; a gate of the third TFT receives the second control signal, a source of the third TFT receives the data signal; another end of the storage capacitor is connected to a first voltage;

the light-emitting module comprises a fifth TFT, a sixth TFT, and a light-emitting element, a gate of the fifth TFT receives the third control signal, a drain of the fifth TFT is connected to the source of the second TFT, a source of the fifth TFT is connected to the drain of the fourth TFT; a gate of the sixth TFT receives the fourth control signal, a drain of the sixth TFT is connected to the first voltage, a source of the sixth TFT is connected to the source of the first TFT; an anode of the light-emitting element is connected to the source of the fifth TFT and the drain of the fourth TFT, a cathode of the light-emitting element is connected to a second voltage;

when the light-emitting element emits light, a driving current through the light-emitting element is satisfied with a formula:

$$I_{OLED}=k(VDD-(V\text{data}-|Vth|)-|Vth|)^2=k(VDD-V\text{data})^2;$$

wherein $I_{OLED}$ is the driving current, VDD is the first voltage, Vdata is a voltage of the data signal, K is a current amplification factor of the first TFT;

wherein a work process of the pixel driving circuit comprises three stages, which are a first stage, a second stage, and a third stage;

in the first stage, the first control and the third control signal are valid, and the second control signal and the fourth control signal are invalid;

in the second stage, the first control signal and the second control signal are valid, and the third control signal and the fourth control signal are invalid;

in the third stage, the third control signal and the fourth control signal are valid, and the first control signal and the second control signal are invalid.

2. The pixel driving circuit of claim 1, wherein the first to sixth TFTs are P-type TFTs;

when the first to fourth control signals are low level signals, the first to fourth control signals are valid;

when the first to fourth control signals are high level signals, the first to fourth control signals are invalid.

3. The pixel driving circuit of claim 2, wherein in the first stage, a voltage of the gate of the first TFT is a reset voltage; in the second stage, the voltage of the gate of the first TFT is difference value between a voltage of the data signal and a threshold voltage of the first TFT.

4. The pixel driving circuit of claim 1, wherein the first voltage is a high level signal, the reset voltage and the second voltage are low level signals.

5. A display apparatus, comprising:

a pixel driving circuit, comprising:

a reset module, configured to receive a first control signal and transmit a reset voltage to a compensation module and a light-emitting module according to the first control signal for resetting the compensation module and the light-emitting module;

the compensation module, configured to receive a second control signal and write data signal according to the second control signal for compensating a threshold voltage; and the light-emitting module, configured to receive a third control signal and a fourth control signal for emitting light according to the third and fourth control signals;

wherein the reset module comprises a second thin film transistor (TFT) and a fourth TFT, a gate of the second TFT receives the first control signal, a source of the second TFT is connected to a drain of the fourth TFT, a drain of the second TFT is connected to the compensation module; a gate of the fourth TFT receives the first control signal, a source of the fourth TFT receives the reset voltage, a drain of the fourth TFT is connected to the source of the second TFT;

wherein the compensation module comprises a first TFT, a third TFT, and a storage capacitor, a gate of the first TFT is connected to an end of the storage capacitor and the drain of the second TFT, a drain of the first TFT is connected to the source of the second TFT, a source of the first TFT is connected to a drain of the third TFT; a gate of the third TFT receives the second control signal, a source of the third TFT receives the data signal; another end of the storage capacitor is connected to a first voltage;

the light-emitting module comprises a fifth TFT, a sixth TFT, and a light-emitting element, a gate of the fifth TFT receives the third control signal, a drain of the fifth TFT is connected to the source of the second TFT, a source of the fifth TFT is connected to the drain of the fourth TFT; a gate of the sixth TFT receives the fourth control signal, a drain of the sixth TFT is connected to the first voltage, a source of the sixth TFT is connected to the source of the first TFT; an anode of the light-emitting element is connected to the source of the fifth TFT and the drain of the fourth TFT, a cathode of the light-emitting element is connected to a second voltage;

when the light-emitting element emits light, a driving current through the light-emitting element is satisfied with a formula:

$$I_{OLED}=k(VDD-(V\text{data}-|Vth|)-|Vth|)^2=k(VDD-V\text{data})^2;$$

wherein $I_{OLED}$ is the driving current, VDD is the first voltage, Vdata is a voltage of the data signal, K is a current amplification factor of the first TFT;

wherein a work process of the pixel driving circuit comprises three stages, which are a first stage, a second stage, and a third stage;

in the first stage, the first control and the third control signal are valid, and the second control signal and the fourth control signal are invalid;

in the second stage, the first control signal and the second control signal are valid, and the third control signal and the fourth control signal are invalid;

in the third stage, the third control signal and the fourth control signal are valid, and the first control signal and the second control signal are invalid.

6. The display apparatus of claim 5, wherein the first to sixth TFTs are P-type TFTs;

when the first to fourth control signals are low level signals, the first to fourth control signals are valid;

when the first to fourth control signals are high level signals, the first to fourth control signals are invalid.

7. The display apparatus of claim 6, wherein in the first stage, a voltage of the gate of the first TFT is a reset voltage; in the second stage, the voltage of the gate of the first TFT is difference value between a voltage of the data signal and a threshold voltage of the first TFT.

8. The display apparatus of claim 5, wherein the first voltage is a high level signal, the reset voltage and the second voltage are low level signals.

* * * * *